US011292014B2

(12) United States Patent
Welborn et al.

(10) Patent No.: US 11,292,014 B2
(45) Date of Patent: Apr. 5, 2022

(54) CENTRIFUGE COUNTERBALANCE WITH ADJUSTABLE CENTER OF GRAVITY AND METHODS FOR USING THE SAME

(71) Applicant: Arteriocyte Medical Systems, Inc., St. Louis, MO (US)

(72) Inventors: Kenneth Welborn, Charlottesville, VA (US); Rodney Sparks, Sacramento, CA (US)

(73) Assignee: Arteriocyte Medical Systems, Inc., St. Louis, MO (US)

( * ) Notice: Subject to any disclaimer, the term of this patent is extended or adjusted under 35 U.S.C. 154(b) by 517 days.

(21) Appl. No.: 15/091,440

(22) Filed: Apr. 5, 2016

(65) Prior Publication Data

US 2016/0296947 A1 Oct. 13, 2016

Related U.S. Application Data

(60) Provisional application No. 62/143,198, filed on Apr. 5, 2015.

(51) Int. Cl.
*B04B 9/14* (2006.01)
*B04B 5/04* (2006.01)

(52) U.S. Cl.
CPC ..... *B04B 9/14* (2013.01); *B04B 5/0421* (2013.01)

(58) Field of Classification Search
CPC ..... B04B 9/14; B04B 5/0421
USPC ..... 494/82
See application file for complete search history.

(56) References Cited

U.S. PATENT DOCUMENTS 1,569,732 A * 1/1926 Elliott ..... F16F 15/283 74/603
1,767,036 A 6/1930 Andresen et al.
1,905,306 A * 4/1933 Roberts ..... B04B 11/05 210/217
2,060,474 A 11/1936 Shriber
2,665,008 A * 1/1954 Call ..... A61C 13/20 164/289
3,655,123 A 4/1972 Judson et al.
(Continued)

FOREIGN PATENT DOCUMENTS

CN 202270585 U 6/2012
EP 0195321 A2 9/1986
(Continued)

OTHER PUBLICATIONS

GPS III Platelet Separation System—Brochure 8 pages, Biomet Biologics, Inc., downloaded on Jul. 29, 2016.
(Continued)

*Primary Examiner* — Walter D. Griffin
*Assistant Examiner* — Shuyi S. Liu
(74) *Attorney, Agent, or Firm* — Polsinelli PC

(57) ABSTRACT

Centrifuge counterbalances having an adjustable center of gravity are provided. Aspects of the centrifuge counterbalances include an elongated body having a distal end and a proximal end, a weight configured to be reversibly immobilized at a position along the longitudinal axis of the elongated body and a base configured to operably couple the centrifuge counterbalance to a centrifuge. Also provided are methods for balancing a centrifuge rotor when separating components of a liquid sample by centrifugation as well as systems suitable for practicing the subject methods.

15 Claims, 4 Drawing Sheets

(56) References Cited

U.S. PATENT DOCUMENTS

| | | | | |
|---|---|---|---|---|
| 3,692,236 | A | 9/1972 | Stanley et al. | |
| 3,965,968 | A * | 6/1976 | Alexandrov | B22D 13/00 164/287 |
| 4,273,181 | A | 6/1981 | Winer | |
| 4,296,882 | A | 10/1981 | Kobayashi | |
| 4,304,357 | A | 12/1981 | Schoendorfer | |
| 4,671,940 | A | 6/1987 | Holen et al. | |
| 5,584,790 | A | 12/1996 | Bell et al. | |
| 5,840,070 | A | 11/1998 | Wampler | |
| 6,080,133 | A | 6/2000 | Wampler | |
| 6,234,998 | B1 | 5/2001 | Wampler | |
| 6,368,083 | B1 | 4/2002 | Wampler | |
| 6,688,861 | B2 | 2/2004 | Wampler | |
| 6,878,105 | B2 | 4/2005 | Smith et al. | |
| 6,982,038 | B2 | 1/2006 | Dolecek et al. | |
| 7,011,761 | B2 | 3/2006 | Muller | |
| 7,032,910 | B2 | 4/2006 | Joie et al. | |
| 7,150,858 | B2 | 12/2006 | Matsuda et al. | |
| 7,252,758 | B2 | 8/2007 | Dolecek et al. | |
| 7,282,154 | B2 | 10/2007 | Muller | |
| 7,306,555 | B2 | 12/2007 | Dolecek et al. | |
| 7,575,423 | B2 | 8/2009 | Wampler | |
| 7,867,159 | B2 | 1/2011 | Dolecek et al. | |
| 8,986,185 | B2 | 3/2015 | Del Vecchio | |
| 2002/0102169 | A1 | 8/2002 | Wampler | |
| 2003/0222029 | A1 | 12/2003 | Muller | |
| 2003/0232712 | A1 | 12/2003 | Dolecek et al. | |
| 2004/0079688 | A1 | 4/2004 | Muller | |
| 2004/0079707 | A1 | 4/2004 | Smith et al. | |
| 2004/0217069 | A1 | 11/2004 | Columbus | |
| 2004/0234397 | A1 | 11/2004 | Wampler | |
| 2006/0060540 | A1 | 3/2006 | Muller | |
| 2006/0124561 | A1 | 6/2006 | Dolecek et al. | |
| 2007/0045201 | A1 | 3/2007 | Dolecek et al. | |
| 2007/0249478 | A1 | 10/2007 | Young | |
| 2007/0293385 | A1 | 12/2007 | Dolecek et al. | |
| 2010/0009831 | A1 * | 1/2010 | Ryu | B04B 9/146 494/8 |
| 2011/0086752 | A1 | 4/2011 | Brierton | |
| 2015/0122977 | A1 * | 5/2015 | Halvorsen | G01N 15/1434 250/214.1 |

FOREIGN PATENT DOCUMENTS

| | | | | |
|---|---|---|---|---|
| EP | 0213343 | B2 | 2/1995 | |
| EP | 0901797 | A2 | 3/1999 | |
| EP | 1531941 | B1 | 11/2010 | |
| JP | 2003-135995 | A | 5/2003 | |
| JP | 2008-518747 | A | 6/2008 | |
| JP | 2009-125616 | A | 6/2009 | |
| JP | 2010-284600 | A | 12/2010 | |
| WO | WO8103626 | A1 | 12/1981 | |
| WO | WO9901198 | A1 | 1/1999 | |
| WO | WO03106040 | A2 | 12/2003 | |
| WO | WO2004037377 | A1 | 5/2004 | |
| WO | WO2006067473 | A1 | 6/2006 | |
| WO | WO-2012021167 | A2 * | 2/2012 | A61M 1/3693 |
| WO | WO2012021167 | A2 | 2/2012 | |

OTHER PUBLICATIONS

Recover Platelet Separation Kit, The Natural Option for Tendon Treatment—Brochure 20 pages, Biomet Biologics, Inc., downloaded on Jul. 29, 2016.

* cited by examiner

100

CENTRIFUGE COUNTERBALANCE WITH ADJUSTABLE CENTER OF GRAVITY AND METHODS FOR USING THE SAME

CROSS-REFERENCE TO RELATED APPLICATIONS

Pursuant to 35 U.S.C. § 119(e), this application claims priority to the filing date of U.S. Provisional Patent Application No. 62/143,198, filed Apr. 5, 2015; the disclosure of which application is herein incorporated by reference.

INTRODUCTION

Centrifugation has been used in the separation of components in a suspended medium to obtain cells, organelles or macromolecules contained in multi-component biologic fluids. Centrifugation of a medium having suspended particles causes the particles to sediment in the direction outward from the axis of rotation. The force generated by centrifugation is proportional to the speed of rotation and the radius of the rotor. At a fixed force and medium viscosity, the sedimentation rate of the particle is proportional to the molecular weight of the particle and the difference between its density and the density of the medium.

The centrifuge is an important scientific experimental tool which employs a rotating centrifugal force to simulate specific gravity field acceleration environment, widely used in aviation, aerospace, marine, weapons, transportation, water, health care, energy and other areas of geophysics basic research and product development, for the development of national defense-related areas, the national economic construction, scientific research and provides an important research tool.

Centrifugation separates components of a sample composition by rapidly spinning the sample in a rotor. To prevent imbalance that can result in wobbling of the rotor during spinning, an equal mass is placed in a rotor compartment opposite the sample composition. Conventionally, the counterweight is a container containing a solvent or water of equal volume to the sample composition. Large imbalances between the counterweight and the sample composition can cause excessive centrifuge vibration resulting in shortened equipment lifetime and even permanent damage to centrifuge system.

The force exerted on the particles during centrifugation (compared to gravity) is called Relative Centrifugal Force (RCF). For example, an RCF of 500×g indicates that the centrifugal force applied is 500 times greater than Earth's gravitational force. The force is usually given as some value times that of gravity (g) and is called RCF. The centrifugal force is dependent upon the radius of the rotation of the rotor and the speed at which it rotates. Rotor speed can be held constant, but the radius will vary from the top of a centrifuge tube to the bottom. If a measurement for the radius is taken as the mid-point, or as an average radius, and all forces are mathematically related to gravity, then one obtains a relative centrifugal force, labeled as ×g. Centrifugation procedures are given as ×g measures, since RPM and other parameters will vary with the particular instrument and rotor used. Relative Centrifugal Force is a constant that is independent of the apparatus used.

Protocols for centrifugation typically specify the amount of acceleration to be applied to the sample, rather than specifying a rotational speed such as revolutions per minute. This distinction is important because two rotors with different diameters running at the same rotational speed will subject samples to different accelerations. During circular motion the acceleration is the product of the radius and the square of the angular velocity and is traditionally named "relative centrifugal force" (RCF). The acceleration is measured in multiples of "g" (or ×"g"), the standard acceleration due to gravity at the Earth's surface, and it is given by:

$$RCF=r(2\pi N)^2/g$$

where:

g is earth's gravitational acceleration, r is the rotational radius,

N is the rotational speed, measured in revolutions per unit of time.

This relationship may be written as:

$$RCF=1.118\times10^{-b}r_{cm}N^2_{RPM}$$

where $r_{cm}$ is the rotational radius measured in centimeters (cm), $N_{RPM}$ is rotational speed measured in revolutions per minute (RPM).

SUMMARY

Centrifuge counterbalances having an adjustable center of gravity are provided. Aspects of the centrifuge counterbalances include an elongated body having a distal end and a proximal end, a weight configured to be reversibly immobilized at a position along the longitudinal axis of the elongated body and a base configured to operably couple the centrifuge counterbalance to a centrifuge. In some embodiments, the subject centrifuge counterbalances include a shaft having a distal end and a proximal end, a weight configured to be reversibly immobilized along a longitudinal axis on the shaft and a base at the distal end of the shaft that is configured to operably couple to a centrifuge. In other embodiments, centrifuge counterbalances include an elongated housing (e.g., a tube) having a distal end and a proximal end, a weight configured to be reversibly immobilized at a position on the longitudinal axis within the housing and a base configured to operably couple the housing to a centrifuge. Also provided are methods for balancing a centrifuge rotor when separating components of a liquid sample by centrifugation as well as systems suitable for practicing the subject methods.

Aspects of the disclosure include centrifuge counterbalances for use in balancing a centrifuge rotor during centrifugation of a liquid sample. Centrifuge counterbalances according to certain embodiments include an elongated body having a distal end and a proximal end, a weight configured to be reversibly immobilized at a position along the longitudinal axis of the elongated body and a base configured to operably couple the centrifuge counterbalance to a centrifuge. For example, the subject centrifuge counterbalances may include a shaft having a distal end and a proximal end, a weight configured to be reversibly immobilized along a longitudinal axis on the shaft and a base at the distal end of the shaft that is configured to be operably coupled to the centrifuge. In certain instances, the centrifuge counterbalance includes an elongated housing, such as a tube, having a distal end and a proximal end, a weight configured to be reversibly immobilized at a position on the longitudinal axis within the housing and a base configured to operably couple the housing to a centrifuge. In embodiments, one or both of the elongated body (e.g., shaft, housing) and the weight may include a fastener to immobilize the weight to the elongated body. Fasteners may be protrusions, grooves, latches, holes or a screw thread. In some embodiments, the elongated body (e.g., shaft) includes a fastener. In other embodiments, the weight includes a fastener. In certain embodiments, both the elongated body and the weight include a fastener. Where the weight and the elongated body both include fasteners, the fastener on the elongated body and the fastener on the weight may be complimentary, where in certain embodiments the elongated body includes protrusions and the weight includes grooves or notches. In other embodiments, the elongated body includes grooves or notches and the weight includes protrusions. In still other embodiments, the weight includes hole with a screw thread extending therethrough and the shaft is screw threaded through the weight.

In some embodiments, the weight is locked in position on the elongated body, such as with a latch, pin or screw. The center of gravity of the subject centrifuge counterbalances is changed by immobilizing the weight at different positions along the longitudinal axis of the elongated body. The centrifuge counterbalance also includes a base at the distal end of the elongated body that is configured to operably couple to a centrifuge. In some embodiments, the base is shaped to couple with the rotor of the centrifuge. For example, the base may be disk-shaped or conically-shaped for positioning in a cylindrical rotor compartment. In certain instances, the base is fixed to the distal end of the elongated body. In other instances, the based is configured to be positioned at different places along the longitudinal axis of the elongated body.

Aspects of the disclosure also include methods for balancing a centrifuge rotor during centrifugation of a liquid sample (e.g., biological sample). Methods according to certain embodiments include positioning a container having a liquid sample (e.g., blood) into a rotor compartment of a centrifuge, positioning the subject centrifuge counterbalance in the rotor compartment diametrically opposed from the rotor compartment of the sample container and subjecting the container and counterbalance to a force of centrifugation sufficient to produce two or more fractions in the liquid sample. In certain embodiments, methods include removing one or more of the separated fractions from the liquid sample, adjusting the position of the weight on the shaft of the counterbalance and subjecting the liquid sample and centrifuge counterbalance to a force of centrifugation. Aspects of the disclosure also include systems for practicing the subject methods.

The present disclosure relates to devices and methods for the balancing of centrifuge vessels in a centrifugal field. Specifically, the present disclosure provides an adjustable (e.g., mechanically) counterweight apparatus and a method for its use that includes a means for adjustment of the center of gravity in order to achieve variable effect as a counterweight in a centrifuge bucket.

In practice according to certain embodiments, a fluid is placed into a container designed for centrifugation. The container is placed into a centrifuge bucket on an arm of a centrifuge. To prevent imbalance from occurring during centrifugation, the subject centrifuge counterbalance is placed into the diametrically opposite centrifuge bucket. For example, the centrifuge counterbalance may include a base, a shaft and a moveable weight that can be fixed at varying positions along the shaft. The specific location of the moveable weight on the shaft is selected according to the amount of fluid that was placed into the container designed for centrifugation. The location can be approximated by calculation or by experimentation for final location for optimal counter balance action (e.g., minimal vibration of centrifuge during centrifugation). In general, the greater the amount of fluid added to the container, the lower the moveable weight will be on the elongated body.

In certain embodiments, the centrifuge counterbalance includes a shaft, a weight and a base. In these embodiments, the base is designed to provide an intended amount of mass and to hold the shaft in an upright position throughout centrifugation. The shaft is designed to provide an intended amount of mass and to function for transporting and securing the moveable weight at discrete points on the shaft which can be correlated to specific amounts of volume of fluid being centrifuged in the opposite centrifuge bucket. The moveable weight is designed to provide an intended amount of mass and to have a simple function of locating it at a fixed position on the shaft such that it will not move during centrifugation. An example of securing the moveable weight to the shaft is the use of an interlocking button mechanism. When depressed, the moveable weight may be repositioned up and down the shaft but when the button is released it allows for a metal slide within the moveable weight to be inserted between the groves of the shaft and thereby causing its further movement to be arrested until the button is pushed again.

BRIEF DESCRIPTION OF THE FIGURES

The invention may be best understood from the following detailed description when read in conjunction with the accompanying drawings. Included in the drawings are the following figures:

FIG. 2A depicts the weight of the centrifuge counterbalance at a first position where the weight is locked at the distal end of the shaft adjacent to the base. FIG. 2B depicts the weight of the centrifuge at a second position where the weight is locked to a position proximal to the first position on the shaft.

DETAILED DESCRIPTION

Figure 1C:
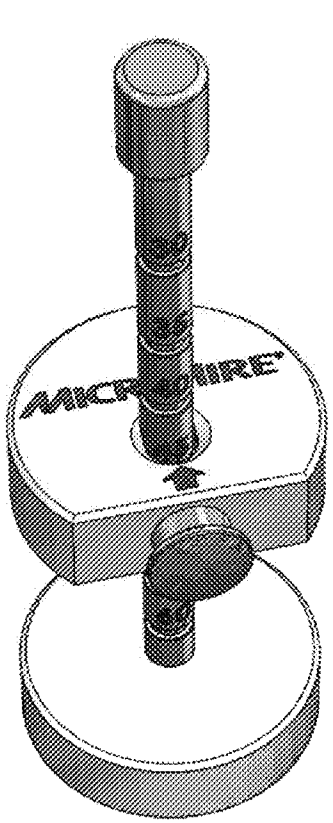
FIG. 1A-1C depicts an example of a centrifuge counterbalance having the weight at two different positions on the shaft according to certain embodiments. The centrifuge counterbalance includes a base, a shaft, a moveable weight and a lock to stably position the weight to a specific location on the shaft during centrifugation.

Centrifuge counterbalances having an adjustable center of gravity are provided. Aspects of the centrifuge counterbalances include an elongated body having a distal end and a proximal end, a weight configured to be reversibly immobilized at a position on the longitudinal axis of the elongated body and a base configured to operably couple the centrifuge counterbalance to a centrifuge. In some embodiments, the subject centrifuge counterbalances include a shaft having a distal end and a proximal end, a weight configured to be reversibly immobilized along a longitudinal axis on the shaft and a base at the distal end of the shaft that is configured to operably couple to a centrifuge. In other embodiments, centrifuge counterbalances include an elongated housing (e.g., a tube) having a distal end and a proximal end, a weight configured to be reversibly immobilized at a position on the longitudinal axis within the housing and a base configured to operably couple the housing to a centrifuge. Also provided are methods for balancing a centrifuge rotor when separating components of a liquid sample by centrifugation as well as systems suitable for practicing the subject methods.

Before the present invention is described in greater detail, it is to be understood that this invention is not limited to particular embodiments described, as such may vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

As summarized above, the present disclosure provides centrifuge counterbalances having an adjustable center of gravity. In further describing embodiments of the disclosure, centrifuge counterbalances are first described in greater detail. Next, methods for balancing a centrifuge rotor during centrifugation with the subject centrifuge counterbalances are described. Systems, including a centrifuge, suitable for practicing the subject methods are also provided.

Centrifuge Counterbalances

As summarized above, aspects of the present disclosure include centrifuge counterbalances having an adjustable center of gravity. The phrase "center of gravity" is used herein in its conventional sense to refer to the position (i.e., point) at which the weight of the centrifuge counterbalance is equally balanced in all directions. In embodiments, the subject centrifuge counterbalances have a center of gravity that can be changed as desired. In other words, the centrifuge counterbalance does not have fixed center of gravity. As described in greater detail below, centrifuge counterbalances of interest include an elongated body having a distal end and a proximal end, a weight configured to be reversibly immobilized at a position on the longitudinal axis of the elongated body and a base configured to operably couple the centrifuge counterbalance to a centrifuge. In some embodiments, the subject centrifuge counterbalances include a shaft having a distal end and a proximal end, a weight configured to be reversibly immobilized along a longitudinal axis on the shaft and a base at the distal end of the shaft. In other embodiments, centrifuge counterbalances include an elongated housing (e.g., a tube) having a distal end and a proximal end, a weight configured to be reversibly immobilized at a position on the longitudinal axis within the housing and a base configured to operably couple the housing to a centrifuge.

In embodiments, the center of gravity of the centrifuge counterbalance is adjusted by immobilizing the weight at different positions along the longitudinal axis of the elongated body (e.g., shaft, housing). For example, the centrifuge counterbalance has a different center of gravity when the weight is positioned at the distal end of the elongated body (e.g., shaft) as compared to when the weight is positioned at the proximal end of the elongated body (e.g., shaft). Likewise, the centrifuge counterbalance has yet a different center of gravity when the weight is positioned between the distal end and the proximal end of the elongated body (e.g., shaft). Accordingly, depending on the length of the elongated body (e.g., shaft) and the position of the weight, the subject centrifuge counterbalances may be adjusted to have a center of gravity that is 1 mm or more from distal end of the elongated body, such as 2 mm or more, such as 5 mm or more, such as 10 mm or more, such as 15 mm or more, such as 20 mm or more, such as 25 mm or more, such as 30 mm or more and including 50 mm or more from the distal end of the elongated body.

Centrifuge counterbalances of interest are configured for balancing a centrifuge rotor during centrifugation of a liquid sample. The term "balance" is used herein in its conventional sense to mean that the centrifuge counterbalance and the container with liquid sample have substantially the same mass or weight during centrifugation. For example, the centrifuge counterbalance and the container with liquid sample have a mass during centrifugation that differs by 5% or less, such as 4% or less, such as 3% or less, such as 2% or less, such as 1% or less, such as 0.5% or less, such as 0.1% or less, such as 0.01% or less and including a mass that differs by 0.001% or less. In certain embodiments, the centrifuge counterbalance and the container with liquid sample have the same mass during centrifugation.

The force exerted on particles during centrifugation (i.e., the relative centrifugal force (RCF)) depends on the mass of the particles and radius of rotation by the rotor. By adjusting the center of gravity (e.g., by changing the position of the weight along the elongated body, as described in greater detail below), the combination of mass and radial distribution of said mass that the subject centrifuge counterbalances can balance during centrifugation may vary. In embodiments, the centrifuge counterbalance may be configured to balance a mass that is 0.1 gram or more, such as 0.5 gram or more, such as 1 gram or more, such as 5 grams or more, such as 10 grams or more, such as 15 grams or more, such as 25 grams or more, such as 50 grams or more, such as 100 grams or more, such as 250 grams or more, such as 500 grams or more, such as 1000 grams or more and including 2500 grams or more. For example, in some embodiments, the centrifuge counterbalance is configured to balance a mass that is from 0.01 grams to 10000 grams, such as from 0.05 grams to 7500 grams, such as from 0.1 grams to 5000 grams, such as from 0.5 grams to 2500 grams, such as from 1 gram to 2000 grams, such as from 5 grams to 1000 grams and including from 10 grams to 500 grams.

In embodiments, centrifuge counterbalances of interest may be configured to balance containers with liquid samples of varying size, where in some instances the liquid sample volume ranges from 1 mL to 10000 mL, such as from 5 mL to 5000 mL, such as from 10 mL to 2500 mL, such as from 15 mL to 1000 mL, such as from 25 mL to 750 mL, such as from 30 mL to 500 mL, such as from 40 mL to 250 mL, and including from 50 mL to 100 mL. In one example, centrifugation counterbalances of interest are configured to balance a liquid sample of 100 mL or less, such as 50 mL or less, such as 25 mL or less, such as 15 mL or less, such as 10 mL or less and including 5 mL or less. In another example, centrifugation counterbalances of interest are configured to balance a liquid sample of 100 mL or more, such as 250 mL or more, such as 500 mL or more, such as 750 mL or more, such as 1000 mL or more and including a liquid sample of 2500 mL or more.

As described in greater detail below, the centrifuge counterbalance is positioned in a rotor compartment that is diametrically opposed from a rotor compartment of the container with liquid sample. To balance, the weight of the centrifuge counterbalance is fixed at a position along the longitudinal axis of the elongated body such that during centrifugation the mass of the centrifuge counterbalance is equivalent to the mass of the sample container with the liquid sample (e.g., centrifuge rotor exhibits little to no wobbling during spinning).

The subject centrifuge counterbalances include an elongated body having a distal end and a proximal end, a weight configured to be reversibly immobilized at a position on the longitudinal axis of the elongated body and a base configured to operably couple the centrifuge counterbalance to a centrifuge. In some embodiments, the elongated body is a shaft that is configured for positioning a weight along the longitudinal axis of the shaft. Depending on the size of the centrifuge rotor, the shaft may be 1 cm or longer, such as 2 cm or longer, such as 3 cm or longer, such as 5 cm or longer, such as 10 cm or longer, such as 15 cm or longer, such as 20 cm or longer, such as 25 cm or longer and including 30 cm or longer. For example, the shaft may range in length from 1 cm to 50 cm, such as from 2 cm to 45 cm, such as from 3 cm to 40 cm, such as from 4 cm to 35 cm and including from 5 cm to 25 cm.

The cross-section of the shaft may be any suitable shape, where cross-sectional shapes of interest include, but are not limited to rectilinear cross sectional shapes, e.g., squares, rectangles, trapezoids, triangles, hexagons, etc., curvilinear cross-sectional shapes, e.g., circles, ovals, as well as irregular shapes, e.g., a parabolic bottom portion coupled to a planar top portion. The cross-section of the shaft may have a surface area ranging from 1 to 500 $mm^2$, such as from 2 to 400 $mm^2$, such as from 3 to 250 $mm^2$, such as 5 to 150 $mm^2$ and including from 10 to 100 $mm^2$. In certain embodiments, the shaft is cylindrical and has a circular cross section. The cross-sectional diameter of cylindrical shafts may by 2 mm or greater, such as 3 mm or greater, such as 4 mm or greater, such as 5 mm or greater, such as 10 mm or greater, such as 15 mm or greater, such as 20 mm or greater and including 25 mm or greater. In these embodiments, the cross-sectional surface area of the cylindrical shaft ranges from 4 to 625 $mm^2$, such as from 9 to 400 $mm^2$, such as from 16 to 225 $mm^2$ and including from 25 to 100 $mm^2$.

The shaft may be solid or hollow. In some embodiments, the shaft is solid. In other embodiments, the shaft is hollow or partially hollow. Where the shaft is hollow, the shaft includes a distal end and a proximal end with walls between the distal end and the proximal end that together form an inner chamber within the shaft. The outer walls of the shaft and the inner chamber in these embodiments may have the same or different cross-sectional shapes. In some embodiments, the cross-sectional shape of the outer walls and inner chamber is the same. In other embodiments, the cross-section shape of the outer walls and the inner chamber is different. For example, both the outer walls of the shaft and the inner chamber may have a circular or oval cross section or the outer walls of the shaft may have a circular cross section and the inner chamber may have a polygonal cross section.

The shaft may be formed from any suitable material, including, but not limited to metal, glass, ceramic, or plastic. In some embodiments, the shaft is formed from a metal, such as aluminum, chromium, cobalt, copper, gold, indium, iron, lead, nickel, tin, steel (e.g., stainless steel), silver, zinc and combinations and alloys thereof. In other embodiments, the shaft is formed from a metal alloy, such as an aluminum alloy, aluminum-lithium alloy, an aluminum-nickel-copper alloy, an aluminum-copper alloy, an aluminum-magnesium alloy, an aluminum-magnesium oxide alloy, an aluminum-silicon alloy, an aluminum-magnesium-manganese-platinum alloy, a cobalt alloy, a cobalt-chromium alloy, a cobalt-tungsten alloy, a cobalt-molybdenum-carbon alloy, a cobalt-chromium-nickel-molybdenum-iron-tungsten alloy, a copper alloy, a copper-arsenic alloy, a copper-beryllium alloy, a copper-silver alloy, a copper-zine alloy (e.g., brass), a copper-tin alloy (e.g., bronze), a copper-nickel alloy, a copper-tungsten alloy, a copper-gold-silver alloy, a copper-nickel-iron alloy, a copper-manganese-tin alloy, a copper-aluminum-zinc-tin alloy, a copper-gold alloy, a gold alloy, a gold-silver alloy, an indium alloy, an indium-tin alloy, an indium-tin oxide alloy, an iron alloy, an iron-chromium alloy (e.g., steel), an iron-chromium-nickel alloy (e.g., stainless steel), an iron-silicon alloy, an iron-chromium-molybdenum alloy, an iron-carbon alloy, an iron-boron alloy, an iron-magnesium alloy, an iron-manganese alloy, an iron molybdenum alloy, an iron-nickel alloy, an iron-phosphorus alloy, an iron-titanium alloy, an iron-vanadium alloy, a lead alloy, a lead-antimony alloy, a lead-copper alloy, a lead-tin alloy, a lead-tin-antimony alloy, a nickel alloy, a nickel-manganese-aluminum-silicon alloy, a nickel-chromium alloy, a nickel-copper alloy, a nickel, molybdenum-chromium-tungsten alloy, a nickel-copper-iron-manganese alloy, a nickel-carbon alloy, a nickel-chromium-iron alloy, a nickel-silicon alloy, a nickel-titanium alloy, a silver alloy, a silver-copper alloy (e.g., sterling silver) a silver-copper-germanium alloy (e.g., Argentium sterling silver), a silver-gold alloy, a silver-copper-gold alloy, a silver-platinum alloy, a tin alloy, a tin-copper-antimony alloy, a tin-lead-copper alloy, a tin-lead-antimony alloy, a titanium alloy, a titanium-vanadium-chromium alloy, a titanium-aluminum alloy, a titanium-aluminum-vanadium alloy, a zinc alloy, a zinc-copper alloy, a zinc-aluminum-magnesium-copper alloy, a zirconium alloy, a zirconium-tin alloy or a combination thereof.

In certain embodiments, the shaft is formed from a plastic, such as a rigid plastic, polymeric or thermoplastic material. For example, suitable plastics may include polycarbonates, polyvinyl chloride (PVC), polyurethanes, polyethers, polyamides, polyimides, or copolymers of these thermoplastics, such as PETG (glycol-modified polyethylene terephthalate), among other polymeric plastic materials. In certain embodiments, the shaft is formed from a polyester, where polyesters of interest may include, but are not limited to poly(alkylene terephthalates) such as poly(ethylene terephthalate) (PET), bottle-grade PET (a copolymer made based on monoethylene glycol, terephthalic acid, and other comonomers such as isophthalic acid, cyclohexene dimethanol, etc.), poly(butylene terephthalate) (PBT), and poly(hexamethylene terephthalate); poly(alkylene adipates) such as poly(ethylene adipate), poly(1,4-butylene adipate), and poly(hexamethylene adipate); poly(alkylene suberates) such as poly(ethylene suberate); poly(alkylene sebacates) such as poly(ethylene sebacate); poly(ϵ-caprolactone) and poly(β-propiolactone); poly(alkylene isophthalates) such as poly(ethylene isophthalate); poly(alkylene 2,6-naphthalene-dicarboxylates) such as poly(ethylene 2,6-naphthalene-dicarboxylate); poly(alkylene sulfonyl-4,4'-dibenzoates) such as poly(ethylene sulfonyl-4,4'-dibenzoate); poly(p-phenylene alkylene dicarboxylates) such as poly(p-phenylene ethylene dicarboxylates); poly(trans-1,4-cyclohexanediyl alkylene dicarboxylates) such as poly(trans-1,4-cyclohexanediyl ethylene dicarboxylate); poly(1,4-cyclohexane-dimethylene alkylene dicarboxylates) such as poly(1,4-cyclohexane-dimethylene ethylene dicarboxylate); poly([2.2.2]-bicyclooctane-1,4-dimethylene alkylene dicarboxylates) such as poly([2.2.2]-bicyclooctane-1,4-dimethylene ethylene dicarboxylate); lactic acid polymers and copolymers such as (S)-polylactide, (R,S)-polylactide, poly(tetramethylglycolide), and poly(lactide-co-glycolide); and polycarbonates of bisphenol A, 3,3'-dimethylbisphenol A, 3,3',5,5'-tetrachlorobisphenol A, 3,3',5,5'-tetramethylbisphenol A; polyamides such as poly(p-phenylene terephthalamide); Mylar™.

Depending on the materials from which the shaft is formed, the density of the shaft may vary, ranging from 0.1 $g/cm^3$ to 25 $g/cm^3$, such as from 0.5 $g/cm^3$ to 20 $g/cm^3$, such as from 1.5 $g/cm^3$ to 22.5 $g/cm^3$, such as from 2 $g/cm^3$ to 20 $g/cm^3$, such as from 2.5 $g/cm^3$ to 17.5 $g/cm^3$, such as from 3 $g/cm^3$ to 15 $g/cm^3$ and including from 5 $g/cm^3$ to 10 $g/cm^3$.

In embodiments, the shaft is configured for a weight to be releasably positioned on the longitudinal axis of the shaft. The term "releasably" is used herein in its conventional sense to mean that the weight can be freely detached from a first position, re-positioned at a second, different position on the shaft and re-attached. In some embodiments, the weight is completely detachable, where the weight can be separated from the shaft. In other embodiments, the weight is coupled to the shaft, such as where the weight includes a hole and the shaft extends through the hole and the weight is displaced by sliding the weight along the length of the shaft.

One or both of the shaft and the weight may include a fastener to immobilize the weight along the longitudinal axis of the shaft. In some embodiments, the shaft includes a fastener that stably immobilizes the weight on the shaft at a plurality of different positions. By stably immobilized is meant that the weight does not move once attached to the shaft, such as during centrifugation. Suitable fasteners on the shaft may include, but are not limited to protrusions, notches, grooves and holes. In certain embodiments, the shaft includes a screw thread and the weight is screw threaded with the shaft.

The number of fasteners on the shaft may vary, ranging from 1 to 100, such as from 2 to 90, such as from 3 to 80, such as from 4 to 70, such as from 5 to 60, such as from 6 to 50, such as from 7 to 40, such as from 8 to 30, such as from 9 to 20 and including from 10 to 15. Fasteners (e.g., protrusions, notches, grooves, holes, etc.) may be positioned at any suitable interval on the shaft. In certain embodiments, the fasteners are at irregular intervals. In other embodiments, fasteners are at regular intervals. For example, fasteners on the shaft may be positioned at increments of every 1 mm or more, such as every 2 mm or more, such as every 3 or more, such as every 4 mm or more, such as every 5 mm or more, such as 10 mm or more, such as every 15 mm or more, such as every 25 mm or more and including every 50 mm or more. Where desired, one or more of the increments may include a reference identifier (i.e., markings). The reference identifiers on the shaft, in certain instances, may further include numerical values (or a data code) adjacent to each marking to identify the mass, volume or weight that the centrifuge counterbalance balances when the weight is positioned at that increment.

In some embodiments, the elongated body is a housing (e.g., tube) having a distal end and a proximal end with walls between the distal end and proximal end that together form an inner chamber that is configured for positioning the weight along the longitudinal axis within the housing. In some embodiments, the outer walls of the housing and inner chamber have the same cross-sectional shape where cross-sectional shapes of interest include, but are not limited to rectilinear cross sectional shapes, e.g., squares, rectangles, trapezoids, triangles, hexagons, etc., curvilinear cross-sectional shapes, e.g., circles, ovals, as well as irregular shapes, e.g., a parabolic bottom portion coupled to a planar top portion. For example, both the outer walls of the housing and the inner chamber may have circular or oval cross sections or both the outer walls of the housing and the inner chamber may have polygonal (e.g., octagonal) cross sections. In other embodiments, the outer walls of the housing and inner chamber within the housing have different cross-sectional shapes (e.g., housing having a circular cross-section and inner chamber having a square or polygonal cross-section)

Depending on the dimensions of the weight (as described below), the size of the inner chamber of the housing may vary, where in some instances the length of the inner chamber of the housing may range from 1 cm to 50 cm, such as from 2.5 cm to 45 cm, such as from 5 cm to 40 cm, such as from 7.5 cm to 35 cm and including from 10 cm to 25 cm and the width of the inner chamber of the housing may range from 0.5 cm to 15 cm, such as from 1 cm to 12.5 cm, such as from 2 cm to 10 cm, such as from 3 cm to 9 cm and including from 4 cm to 8 cm. Where the inner chamber of the housing has a cylindrical cross-section, the diameter may vary, in some embodiments, ranging from 0.5 cm to 15 cm, such as from 1 cm to 12.5 cm, such as from 2 cm to 10 cm, such as from 3 cm to 9 cm and including from 4 cm to 8 cm. Accordingly, the volume of the inner chamber within the housing may vary, ranging from 0.25 to 225 $cm^3$, such as 0.50 to 200 $cm^3$, such as 1 to 150 $cm^3$, such as 5 to 125 $cm^3$, such as 10 to 100 $cm^3$, such as 15 to 75 $cm^3$, and including 20 to 50 $cm^3$.

In embodiments, the housing is configured for a weight to be releasably positioned along the longitudinal axis within the inner chamber. In some embodiments, the weight is completely detachable, where the weight can be separated from the housing. In other embodiments, the weight is coupled within the housing, such as where the weight and the housing are screw threaded together.

One or both of the housing and the weight may include a fastener to immobilize the weight within the inner chamber of the housing. In some embodiments, the inner chamber includes a fastener that stably immobilizes the weight within the housing at a plurality of different positions. By stably immobilized is meant that the weight does not move once positioned in the housing, such as during centrifugation. Suitable fasteners in the inner chamber may include, but are not limited to protrusions, notches, grooves and holes. In certain embodiments, the walls of the inner chamber include a screw thread and the weight in screwed threaded within the housing.

The number of fasteners in the inner chamber may vary, ranging from 1 to 100, such as from 2 to 90, such as from 3 to 80, such as from 4 to 70, such as from 5 to 60, such as from 6 to 50, such as from 7 to 40, such as from 8 to 30, such as from 9 to 20 and including from 10 to 15. Fasteners (e.g., protrusions, notches, grooves, holes, etc.) may be positioned at any suitable interval within the housing. In certain embodiments, the fasteners are at irregular intervals. In other embodiments, fasteners are at regular intervals. For example, fasteners may be positioned on the walls of the inner chamber at increments of every 1 mm or more, such as every 2 mm or more, such as every 3 or more, such as every 4 mm or more, such as every 5 mm or more, such as 10 mm or more, such as every 15 mm or more, such as every 25 mm or more and including every 50 mm or more. Where desired, one or more of the increments may include a reference identifier (i.e., markings). The reference identifiers, in certain instances, may further include numerical values (or a data code) adjacent to each marking to identify the mass, volume or weight that the centrifuge counterbalance balances when the weight is positioned at that increment.

The housing may be formed from any suitable material, including, but not limited to metal, glass, ceramic, or plastic. In certain embodiments, the housing is formed from a plastic, such as a rigid plastic, polymeric or thermoplastic material. For example, suitable plastics may include polycarbonates, polyvinyl chloride (PVC), polyurethanes, polyethers, polyamides, polyimides, or copolymers of these thermoplastics, such as PETG (glycol-modified polyethylene terephthalate), among other polymeric plastic materials. In certain embodiments, the shaft is formed from a polyester, where polyesters of interest may include, but are not limited to poly(alkylene terephthalates) such as poly(ethylene terephthalate) (PET), bottle-grade PET (a copolymer made based on monoethylene glycol, terephthalic acid, and other comonomers such as isophthalic acid, cyclohexene dimethanol, etc.), poly(butylene terephthalate) (PBT), and poly (hexamethylene terephthalate); poly(alkylene adipates) such as poly(ethylene adipate), poly(1,4-butylene adipate), and poly(hexamethylene adipate); poly(alkylene suberates) such as poly(ethylene suberate); poly(alkylene sebacates) such as poly(ethylene sebacate); poly(ϵ-caprolactone) and poly(β-propiolactone); poly(alkylene isophthalates) such as poly (ethylene isophthalate); poly(alkylene 2,6-naphthalene-dicarboxylates) such as poly(ethylene 2,6-naphthalene-dicarboxylate); poly(alkylene sulfonyl-4,4'-dibenzoates) such as poly(ethylene sulfonyl-4,4'-dibenzoate); poly(p-phenylene alkylene dicarboxylates) such as poly(p-phenylene ethylene dicarboxylates); poly(trans-1,4-cyclohexanediyl alkylene dicarboxylates) such as poly(trans-1,4-cyclohexanediyl ethylene dicarboxylate); poly(1,4-cyclohexane-dimethylene alkylene dicarboxylates) such as poly(1,4-cyclohexane-dimethylene ethylene dicarboxylate); poly ([2.2.2]-bicyclooctane-1,4-dimethylene alkylene dicarboxylates) such as poly([2.2.2]-bicyclooctane-1,4-dimethylene ethylene dicarboxylate); lactic acid polymers and copolymers such as (S)-polylactide, (R,S)-polylactide, poly (tetramethylglycolide), and poly(lactide-co-glycolide); and polycarbonates of bisphenol A, 3,3'-dimethylbisphenol A, 3,3',5,5'-tetrachlorobisphenol A, 3,3',5,5'-tetramethylbisphenol A; polyamides such as poly(p-phenylene terephthalamide); Mylar™.

Depending on the materials from which the housing is formed, the density of the housing may vary, ranging from 0.1 $g/cm^3$ to 25 $g/cm^3$, such as from 0.5 $g/cm^3$ to 20 $g/cm^3$, such as from 1.5 $g/cm^3$ to 22.5 $g/cm^3$, such as from 2 $g/cm^3$ to 20 $g/cm^3$, such as from 2.5 $g/cm^3$ to 17.5 $g/cm^3$, such as from 3 $g/cm^3$ to 15 $g/cm^3$ and including from 5 $g/cm^3$ to 10 $g/cm^3$.

As summarized above, the subject centrifuge counterbalances also include a weight that is configured to be positioned along the longitudinal axis of the elongated body (e.g., shaft, housing), such as 1 mm or more from distal end of the elongated body, such as 2 mm or more, such as 5 mm or more, such as 10 mm or more, such as 15 mm or more, such as 20 mm or more, such as 25 mm or more, such as 30 mm or more and including 50 mm or more from the distal end of the elongated body.

In certain embodiments, the elongated body is a shaft and the weight may be immobilized at any position from the proximal end to distal end of the shaft depending on the desired center of gravity. For example, the weight may be positioned 1 mm or more from distal end of the shaft, such as 2 mm or more, such as 5 mm or more, such as 10 mm or more, such as 15 mm or more, such as 20 mm or more, such as 25 mm or more, such as 30 mm or more and including 50 mm or more from the distal end of the shaft. In some embodiments, the weight is positioned relative to the base on the shaft, and may be positioned 1 mm or more from the base, such as 2 mm or more, such as 5 mm or more, such as 10 mm or more, such as 15 mm or more, such as 20 mm or more, such as 25 mm or more, such as 30 mm or more and including 50 mm or more from the base.

In embodiments, the weight is releasably and stably immobilized on the elongated body (e.g., shaft). In some embodiments, the weight includes one or more fasteners for stably immobilizing the weight. For example, the fastener on the weight may be a protrusion, notch, a groove, a pin or a hole. The weight may include one or more fasteners, such as two or more, such as three or more and including 5 or more fasteners.

In certain instances, both the elongated body and the weight include fasteners. Where both the elongated body and the weight include fasteners, the fasteners on the weight couple (i.e., are complimentary) to the fasteners of the elongated body. For example, where the shaft or housing includes protrusions, the weight includes grooves or notches. In other embodiments, the shaft or housing includes grooves or notches and the weight includes protrusions. In still other embodiments, the weight includes hole with a screw thread extending therethrough and the shaft is screw threaded into the weight. In other embodiments, the outer walls of the weight include a screw thread and is screw threaded with the inner walls of the housing.

In certain embodiments, the weight is reversibly locked into position. In these embodiments, once the weight is locked in position, the weight must be unlocked in order to detach or otherwise move the weight to a different position along the longitudinal axis of the elongated body (e.g., shaft). The weight may be reversibly locked into position by any convenient protocol, such as for example a lock present on the weight which engages with a fastener (e.g., notch) on the elongated body. For instance, the lock may be a locking latch, a locking pin or a locking screw. The lock may be a spring actuated latch or pin. In some embodiments, the lock is a button present on the weight which actuates the latch or pin to lock the weight at the desired position. In certain embodiments, the lock is a screw which extends through the weight and is screw threaded into a hole.

The weight may be any suitable shape, where cross-sectional shapes of interest include, but are not limited to rectilinear cross sectional shapes, e.g., squares, rectangles, trapezoids, triangles, hexagons, etc., curvilinear cross-sectional shapes, e.g., circles, ovals, as well as irregular shapes, e.g., a parabolic bottom portion coupled to a planar top portion. In certain embodiments, the weight has a shape that is same as (i.e., complimentary to) the inner walls of a centrifuge rotor compartment. In one example, the weight has a circular shape. In other embodiments, the weight has a polygonal shape, such as an octagonal shape. In other embodiments, the weight has a shape that includes a curved bottom portion coupled to a planar top portion. In certain embodiments, the weight is disc-shaped having a circular cross section.

In certain embodiments, the weight has a hole that extends through the weight and the elongated body (e.g., shaft) is inserted through the hole in the weight. In these embodiments, the width (e.g., diameter when the elongated body is cylindrical) of the elongated body is less than the width (e.g., diameter when hole in the weight is circular) of the hole through the weight so that the weight can readily slide along the length of the elongated body. For example, the width of the elongated body may be about 0.5% smaller or more than the width of the hole in the weight, such as 1% smaller or more, such as 2% smaller or more, such as 3% smaller or more, such as 5% smaller or more and including 10% smaller or more. In certain embodiments, the hole in the weight has a screw thread and is screw threaded with the outer walls of the elongated body (e.g., shaft).

The width of the weight varies and may 0.5 cm or longer, such as 1 cm or longer, such as 2 cm or longer and including 3 cm or longer. For example, the width of the weight may range from 0.5 cm to 5 cm, such as from 1 cm to 4 cm and including from 1.5 cm to 3.5 cm. Where the weight has a circular cross-section, the diameter of the weight may be 0.5 cm or longer, such as 1 cm or longer, such as 2 cm or longer and including 3 cm or longer. For example, the diameter of the weight ranges from 0.5 cm to 5 cm, such as from 1 cm to 4 cm and including from 1.5 cm to 3.5 cm.

The height of the weight varies depending on the length of the elongated body and may be 1 cm or longer, such as 2 cm or longer, such as 3 cm or longer, and including 5 cm or longer. For example, the height of the weight may range from 1 cm to 5 cm, such as from 2 cm to 4 cm and including from 1.5 cm to 3.5 cm. The weight may have a surface area ranging from 0.1 to 10 $cm^2$, such as from 0.5 to 9 $cm^2$, such as from 1 to 8 $cm^2$, such as 2 to 7 $cm^2$ and including from 3 to 6 $cm^2$.

The mass of the weight may vary as desired, ranging from 0.5 g to 2500 g, such as from 1 g to 2000 g, such as from 5 g to 1500 g, such as from 10 g to 1000 g, such as from 25 g to 750 g and including from 50 g to 500 g. Depending on the density of the material from which the weight is formed (described below), the volume of the weight may range from 0.1 to 100 $cm^3$, such as from 0.5 to 75 $cm^3$, such as from 1 to 50 $cm^3$, such as 2 to 25 $cm^3$ and including from 3 to 10 $cm^3$ In certain embodiments, the weight is disc shaped, having a circular cross-section. In these embodiments, the weight may have a diameter that is 0.5 cm or longer, such as 1 cm or longer, such as 2 cm or longer and including 3 cm or longer. The height of the disc-shaped weight may be 5 mm or more, such as 10 mm or more, such as 15 mm or more, such as 20 mm or more, such as 25 mm or more, such as 30 mm or more and including 50 mm or more.

The weight may be formed from any suitable material, including, but not limited to metal, glass, ceramic or plastic. In some embodiments, the weight is formed from a metal, such as aluminum, chromium, cobalt, copper, gold, indium, iron, lead, tin, steel (e.g., stainless steel), silver, zinc and combinations and alloys thereof. In other embodiments, the weight is formed from a metal alloy, such as an aluminum alloy, aluminum-lithium alloy, an aluminum-nickel-copper alloy, an aluminum-copper alloy, an aluminum-magnesium alloy, an aluminum-magnesium oxide alloy, an aluminum-silicon alloy, an aluminum-magnesium-manganese-platinum alloy, a cobalt alloy, a cobalt-chromium alloy, a cobalt-tungsten alloy, a cobalt-molybdenum-carbon alloy, a cobalt-chromium-nickel-molybdenum-iron-tungsten alloy, a copper alloy, a copper-arsenic alloy, a copper-beryllium alloy, a copper-silver alloy, a copper-zine alloy (e.g., brass), a copper-tin alloy (e.g., bronze), a copper-nickel alloy, a copper-tungsten alloy, a copper-gold-silver alloy, a copper-nickel-iron alloy, a copper-manganese-tin alloy, a copper-aluminum-zinc-tin alloy, a copper-gold alloy, a gold alloy, a gold-silver alloy, an indium alloy, an indium-tin alloy, an indium-tin oxide alloy, an iron alloy, an iron-chromium alloy (e.g., steel), an iron-chromium-nickel alloy (e.g., stainless steel), an iron-silicon alloy, an iron-chromium-molybdenum alloy, an iron-carbon alloy, an iron-boron alloy, an iron-magnesium alloy, an iron-manganese alloy, an iron molybdenum alloy, an iron-nickel alloy, an iron-phosphorus alloy, an iron-titanium alloy, an iron-vanadium alloy, a lead alloy, a lead-antimony alloy, a lead-copper alloy, a lead-tin alloy, a lead-tin-antimony alloy, a nickel alloy, a nickel-manganese-aluminum-silicon alloy, a nickel-chromium alloy, a nickel-copper alloy, a nickel, molybdenum-chromium-tungsten alloy, a nickel-copper-iron-manganese alloy, a nickel-carbon alloy, a nickel-chromium-iron alloy, a nickel-silicon alloy, a nickel-titanium alloy, a silver alloy, a silver-copper alloy (e.g., sterling silver) a silver-copper-germanium alloy (e.g., Argentium sterling silver), a silver-gold alloy, a silver-copper-gold alloy, a silver-platinum alloy, a tin alloy, a tin-copper-antimony alloy, a tin-lead-copper alloy, a tin-lead-antimony alloy, a titanium alloy, a titanium-vanadium-chromium alloy, a titanium-aluminum alloy, a titanium-aluminum-vanadium alloy, a zinc alloy, a zinc-copper alloy, a zinc-aluminum-magnesium-copper alloy, a zirconium alloy, a zirconium-tin alloy or a combination thereof.

In certain embodiments, the weight is formed from a plastic, such as a rigid plastic, polymeric or thermoplastic material. For example, suitable plastics may include polycarbonates, polyvinyl chloride (PVC), polyurethanes, polyethers, polyamides, polyimides, or copolymers of these thermoplastics, such as PETG (glycol-modified polyethylene terephthalate), among other polymeric plastic materials. In certain embodiments, the weight is formed from a polyester, where polyesters of interest may include, but are not limited to poly(alkylene terephthalates) such as poly(ethylene terephthalate) (PET), bottle-grade PET (a copolymer made based on monoethylene glycol, terephthalic acid, and other comonomers such as isophthalic acid, cyclohexene dimethanol, etc.), poly(butylene terephthalate) (PBT), and poly(hexamethylene terephthalate); poly(alkylene adipates) such as poly(ethylene adipate), poly(1,4-butylene adipate), and poly(hexamethylene adipate); poly(alkylene suberates) such as poly(ethylene suberate); poly(alkylene sebacates) such as poly(ethylene sebacate); poly(ε-caprolactone) and poly(β-propiolactone); poly(alkylene isophthalates) such as poly(ethylene isophthalate); poly(alkylene 2,6-naphthalene-dicarboxylates) such as poly(ethylene 2,6-naphthalene-dicarboxylate); poly(alkylene sulfonyl-4,4'-dibenzoates) such as poly(ethylene sulfonyl-4,4'-dibenzoate); poly(p-phenylene alkylene dicarboxylates) such as poly(p-phenylene ethylene dicarboxylates); poly(trans-1,4-cyclohexanediyl alkylene dicarboxylates) such as poly(trans-1,4-cyclohexanediyl ethylene dicarboxylate); poly(1,4-cyclohexane-dimethylene alkylene dicarboxylates) such as poly(1,4-cyclohexane-dimethylene ethylene dicarboxylate); poly([2.2.2]-bicyclooctane-1,4-dimethylene alkylene dicarboxylates) such as poly([2.2.2]-bicyclooctane-1,4-dimethylene ethylene dicarboxylate); lactic acid polymers and copolymers such as (S)-polylactide, (R,S)-polylactide, poly(tetramethylglycolide), and poly(lactide-co-glycolide); and polycarbonates of bisphenol A, 3,3'-dimethylbisphenol A, 3,3',5,5'-tetrachlorobisphenol A, 3,3',5,5'-tetramethylbisphenol A; polyamides such as poly(p-phenylene terephthalamide); Mylar™.

In some embodiments, the weight and elongated body are formed from the same material. In other embodiments, the weight and the elongated body are formed from different materials. Depending on the materials from which the weight is formed, the density of the weight may vary, ranging from 0.1 g/cm$^3$ to 25 g/cm$^3$, such as from 0.5 g/cm$^3$ to 20 g/cm$^3$, such as from 1.5 g/cm$^3$ to 22.5 g/cm$^3$, such as from 2 g/cm$^3$ to 20 g/cm$^3$, such as from 2.5 g/cm$^3$ to 17.5 g/cm$^3$, such as from 3 g/cm$^3$ to 15 g/cm$^3$ and including from 5 g/cm$^3$ to 10 g/cm$^3$.

The weight may be solid or hollow. In some embodiments, the weight is solid (e.g., solid stainless steel). In other embodiments, the weight is hollow or partially hollow. Where the weight is hollow, the weight may include an inner chamber having a liquid composition. In certain embodiments, the weight may include one or more ports for inputting (or removing) the liquid composition into the hollow portion of the weight, such as inputting an aqueous composition or high density liquid into the weight. For example, the liquid composition may have a density that is 1 g/mL or more, such as 1.5 g/mL or more, such as 2 g/mL or more, such as 3 g/mL or more, such as 4 g/mL or more and including 5 g/mL or more.

The subject centrifuge counterbalances also include a base configured to operably couple the centrifuge counterbalance to the centrifuge. In some embodiments, the base is fixed to the distal end of the elongated body (e.g., shaft). In other embodiments, the base is fixed at a distance from the distal end of the elongated body (e.g., shaft), such as 1 mm or more from the distal end of the shaft, such as 2 mm or more, such as 5 mm or more, such as 10 mm or more and including 15 mm or more.

In certain embodiments, the base is releasably positioned on the shaft distal to the weight. For example the base may be positioned 1 mm or more from the distal end of the shaft, such as 2 mm or more, such as 5 mm or more, such as 10 mm or more and including 15 mm or more. The base may be positioned on the shaft by one or more fasteners that couple (i.e., is complimentary) to the fasteners of the shaft. For example, the fastener on the base may be a protrusion, notch, a groove, a pin or a hole. In certain embodiments, base is screw threaded to the distal end of the shaft.

In embodiments, the base may be reversibly locked into position on the elongated body. The lock may be reversibly locked to the elongated body by any convenient protocol, such as a locking latch, a locking pin or a locking screw. For example, the lock may be a spring actuated latch or pin. In some embodiments, the lock is a button on the base which actuates the latch or pin to lock the weight at the desired position. In certain embodiments, the lock is a screw which extends through the base and is screw threaded into a hole on the elongated body. In certain embodiments, the base is locked to the shaft by being screw threaded to the distal end of the elongated body.

The base may be any suitable shape, where in some embodiments, the cross-sectional shapes of interest include, but are not limited to rectilinear cross sectional shapes, e.g., squares, rectangles, trapezoids, triangles, hexagons, etc., curvilinear cross-sectional shapes, e.g., circles, ovals, as well as irregular shapes, e.g., a parabolic bottom portion coupled to a planar top portion. In certain embodiments, the cross-section of the base is configured to be complimentary to the inner walls of a centrifuge rotor compartment. As summarized above, the base is configured to be operably coupled with the centrifuge during centrifugation. In some embodiments, the base is shaped to fit in a rotor compartment such that the subject centrifuge counterbalance does not move or tilt during centrifugation. In certain instances, the base has a width (e.g., diameter when the base has a circular cross section) that is nearly the same as the rotor compartment. For example, the width of the base and the width of the rotor compartment may differ by 3% or less, such as 2% or less, such as 1% or less, such as 0.5% or less and including 0.1% or less. In one example, where the base has a circular cross section, the diameter of the base differs from the diameter of the rotor compartment by 5 mm or less, such as 4 mm or less, such as 3 mm or less, such as 2 mm or less, such as 1 mm or less, and including 0.5 mm or less.

In some embodiments, the bottom of the base is shaped to be complimentary to the rotor compartment. In one example, the bottom of the base is frustoconically shaped. In another example, the bottom of the base is hemispherically shaped. In yet another example, the bottom of the base is polygonal such as square or triangular.

The width of the base varies and may 0.5 cm or longer, such as 1 cm or longer, such as 2 cm or longer and including 3 cm or longer. For example, the width of the base may range from 0.5 cm to 5 cm, such as from 1 cm to 4 cm and including from 1.5 cm to 3.5 cm. Where the base has a circular cross-section, the diameter of the base may be 0.5 cm or longer, such as 1 cm or longer, such as 2 cm or longer and including 3 cm or longer. For example, the diameter of the base ranges from 0.5 cm to 5 cm, such as from 1 cm to 4 cm and including from 1.5 cm to 3.5 cm.

The length of the base varies and may be 1 cm or longer, such as 2 cm or longer, such as 3 cm or longer, and including 5 cm or longer. For example, the length of the base may range from 1 cm to 5 cm, such as from 2 cm to 4 cm and including from 1.5 cm to 3.5 cm. The base may have a surface area ranging from 0.1 to 10 $cm^2$, such as from 0.5 to 9 $cm^2$, such as from 1 to 8 $cm^2$, such as 2 to 7 $cm^2$ and including from 3 to 6 $cm^2$.

The mass of the base may vary as desired, ranging from 0.5 g to 2500 g, such as from 1 g to 2000 g, such as from 5 g to 1500 g, such as from 10 g to 1000 g, such as from 25 g to 750 g and including from 50 g to 500 g. Depending on the density of the material from which the base is formed (described below), the volume of the base may range from 0.1 to 100 $cm^3$, such as from 0.5 to 75 $cm^3$, such as from 1 to 50 $cm^3$, such as 2 to 25 $cm^3$ and including from 3 to 10 $cm^3$ In certain embodiments, the base is disc shaped, having a circular cross-section. In these embodiments, the base may have a diameter that is 0.5 cm or longer, such as 1 cm or longer, such as 2 cm or longer and including 3 cm or longer. The height of the disc-shaped base may be 5 mm or more, such as 10 mm or more, such as 15 mm or more, such as 20 mm or more, such as 25 mm or more, such as 30 mm or more and including 50 mm or more.

The base may be formed from any suitable material, including, but not limited to metal, glass, ceramic or plastic. In some embodiments, the base is formed from a metal, such as aluminum, chromium, cobalt, copper, gold, indium, iron, lead, tin steel (e.g., stainless steel), silver, zinc and combinations and alloys thereof. In other embodiments, the base is formed from a metal alloy, such as an aluminum alloy, aluminum-lithium alloy, an aluminum-nickel-copper alloy, an aluminum-copper alloy, an aluminum-magnesium alloy, an aluminum-magnesium oxide alloy, an aluminum-silicon alloy, an aluminum-magnesium-manganese-platinum alloy, a cobalt alloy, a cobalt-chromium alloy, a cobalt-tungsten alloy, a cobalt-molybdenum-carbon alloy, a cobalt-chromium-nickel-molybdenum-iron-tungsten alloy, a copper alloy, a copper-arsenic alloy, a copper-beryllium alloy, a copper-silver alloy, a copper-zine alloy (e.g., brass), a copper-tin alloy (e.g., bronze), a copper-nickel alloy, a copper-tungsten alloy, a copper-gold-silver alloy, a copper-nickel-iron alloy, a copper-manganese-tin alloy, a copper-aluminum-zinc-tin alloy, a copper-gold alloy, a gold alloy, a gold-silver alloy, an indium alloy, an indium-tin alloy, an indium-tin oxide alloy, an iron alloy, an iron-chromium alloy (e.g., steel), an iron-chromium-nickel alloy (e.g., stainless steel), an iron-silicon alloy, an iron-chromium-molybdenum alloy, an iron-carbon alloy, an iron-boron alloy, an iron-magnesium alloy, an iron-manganese alloy, an iron molybdenum alloy, an iron-nickel alloy, an iron-phosphorus alloy, an iron-titanium alloy, an iron-vanadium alloy, a lead alloy, a lead-antimony alloy, a lead-copper alloy, a lead-tin alloy, a lead-tin-antimony alloy, a nickel alloy, a nickel-manganese-aluminum-silicon alloy, a nickel-chromium alloy, a nickel-copper alloy, a nickel, molybdenum-chromium-tungsten alloy, a nickel-copper-iron-manganese alloy, a nickel-carbon alloy, a nickel-chromium-iron alloy, a nickel-silicon alloy, a nickel-titanium alloy, a silver alloy, a silver-copper alloy (e.g., sterling silver) a silver-copper-germanium alloy (e.g., Argentium sterling silver), a silver-gold alloy, a silver-copper-gold alloy, a silver-platinum alloy, a tin alloy, a tin-copper-antimony alloy, a tin-lead-copper alloy, a tin-lead-antimony alloy, a titanium alloy, a titanium-vanadium-chromium alloy, a titanium-aluminum alloy, a titanium-aluminum-vanadium alloy, a zinc alloy, a zinc-copper alloy, a zinc-aluminum-magnesium-copper alloy, a zirconium alloy, a zirconium-tin alloy or a combination thereof.

In certain embodiments, the base is formed from a plastic, such as a rigid plastic, polymeric or thermoplastic material. For example, suitable plastics may include polycarbonates, polyvinyl chloride (PVC), polyurethanes, polyethers, polyamides, polyimides, or copolymers of these thermoplastics, such as PETG (glycol-modified polyethylene terephthalate), among other polymeric plastic materials. In certain embodiments, the base is formed from a polyester, where polyesters of interest may include, but are not limited to poly(alkylene terephthalates) such as poly(ethylene terephthalate) (PET), bottle-grade PET (a copolymer made based on monoethylene glycol, terephthalic acid, and other comonomers such as isophthalic acid, cyclohexene dimethanol, etc.), poly(butylene terephthalate) (PBT), and poly(hexamethylene terephthalate); poly(alkylene adipates) such as poly(ethylene adipate), poly(1,4-butylene adipate), and poly(hexamethylene adipate); poly(alkylene suberates) such as poly(ethylene suberate); poly(alkylene sebacates) such as poly(ethylene sebacate); poly(ϵ-caprolactone) and poly(β-propiolactone); poly(alkylene isophthalates) such as poly(ethylene isophthalate); poly(alkylene 2,6-naphthalene-dicarboxylates) such as poly(ethylene 2,6-naphthalene-dicarboxylate); poly(alkylene sulfonyl-4,4'-dibenzoates) such as poly(ethylene sulfonyl-4,4'-dibenzoate); poly(p-phenylene alkylene dicarboxylates) such as poly(p-phenylene ethylene dicarboxylates); poly(trans-1,4-cyclohexanediyl alkylene dicarboxylates) such as poly(trans-1,4-cyclohexanediyl ethylene dicarboxylate); poly(1,4-cyclohexane-dimethylene alkylene dicarboxylates) such as poly(1,4-cyclohexane-dimethylene ethylene dicarboxylate); poly([2.2.2]-bicyclooctane-1,4-dimethylene alkylene dicarboxylates) such as poly([2.2.2]-bicyclooctane-1,4-dimethylene ethylene dicarboxylate); lactic acid polymers and copolymers such as (S)-polylactide, (R,S)-polylactide, poly(tetramethylglycolide), and poly(lactide-co-glycolide); and polycarbonates of bisphenol A, 3,3'-dimethylbisphenol A, 3,3',5,5'-tetrachlorobisphenol A, 3,3',5,5'-tetramethylbisphenol A; polyamides such as poly(p-phenylene terephthalamide); Mylar™.

In some embodiments, the base and weight are formed from the same material. In other embodiments, the base and the weight are formed from different materials. Depending on the materials from which the base is formed, the density of the base may vary, ranging from 0.1 g/$cm^3$ to 25 g/$cm^3$, such as from 0.5 g/$cm^3$ to 20 g/$cm^3$, such as from 1.5 g/$cm^3$ to 22.5 g/$cm^3$, such as from 2 g/$cm^3$ to 20 g/$cm^3$, such as from 2.5 g/$cm^3$ to 17.5 g/$cm^3$, such as from 3 g/$cm^3$ to 15 g/$cm^3$ and including from 5 g/$cm^3$ to 10 g/$cm^3$.

The base may be solid or hollow. In some embodiments, the base is solid (e.g., solid stainless steel). In other embodiments, the base is hollow or partially hollow. Where the base is hollow, the base may include an inner chamber having a liquid composition. In certain embodiments, the base may include one or more ports for inputting (or removing) the liquid composition into the hollow portion of the base, such as inputting an aqueous composition or high density liquid into the base. For example, the liquid composition may have a density that is 1 g/mL or more, such as 1.5 g/mL or more, such as 2 g/mL or more, such as 3 g/mL or more, such as 4 g/mL or more and including 5 g/mL or more.

Figure 1B:
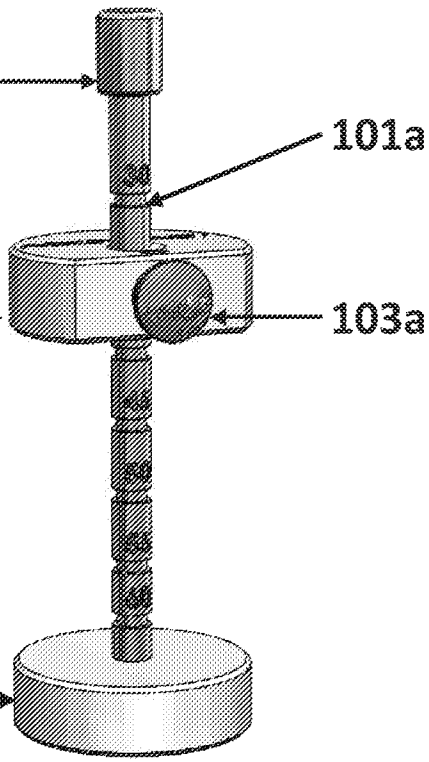
Figure 1A:
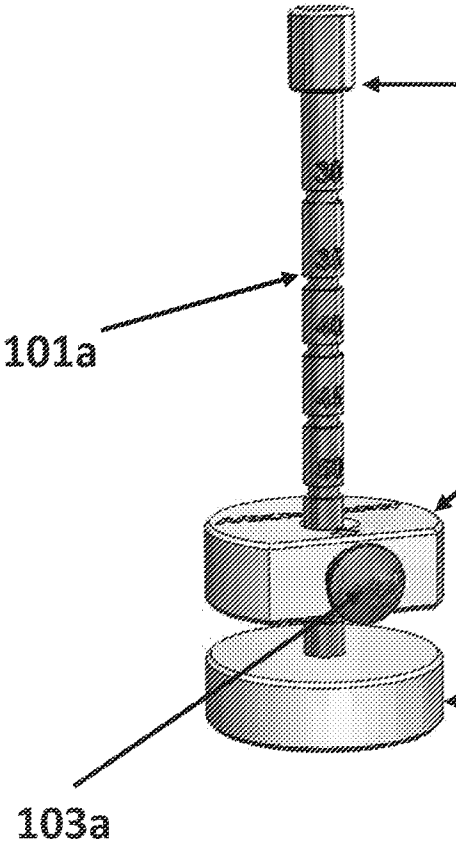

FIG. 1A-1C depicts an example of a centrifuge counterbalance according to certain embodiments having the weight at two different positions on a shaft. Device 100 includes a shaft 101, a base 102 fixed to the distal end of the shaft and a weight 103. In the first position, weight 103 is stably positioned at the most distal location on shaft 101 adjacent to base 102. Shaft 101 includes a plurality of grooves **101*a* for stably positioning the weight at different positions along the longitudinal axis of the shaft. Weight 103 includes a lock 103***a* for locking the weight into position on the shaft. In the second position, weight 103 is displaced proximally along the longitudinal axis of the shaft and locked into place using lock 103*a*.

Figure 2A:
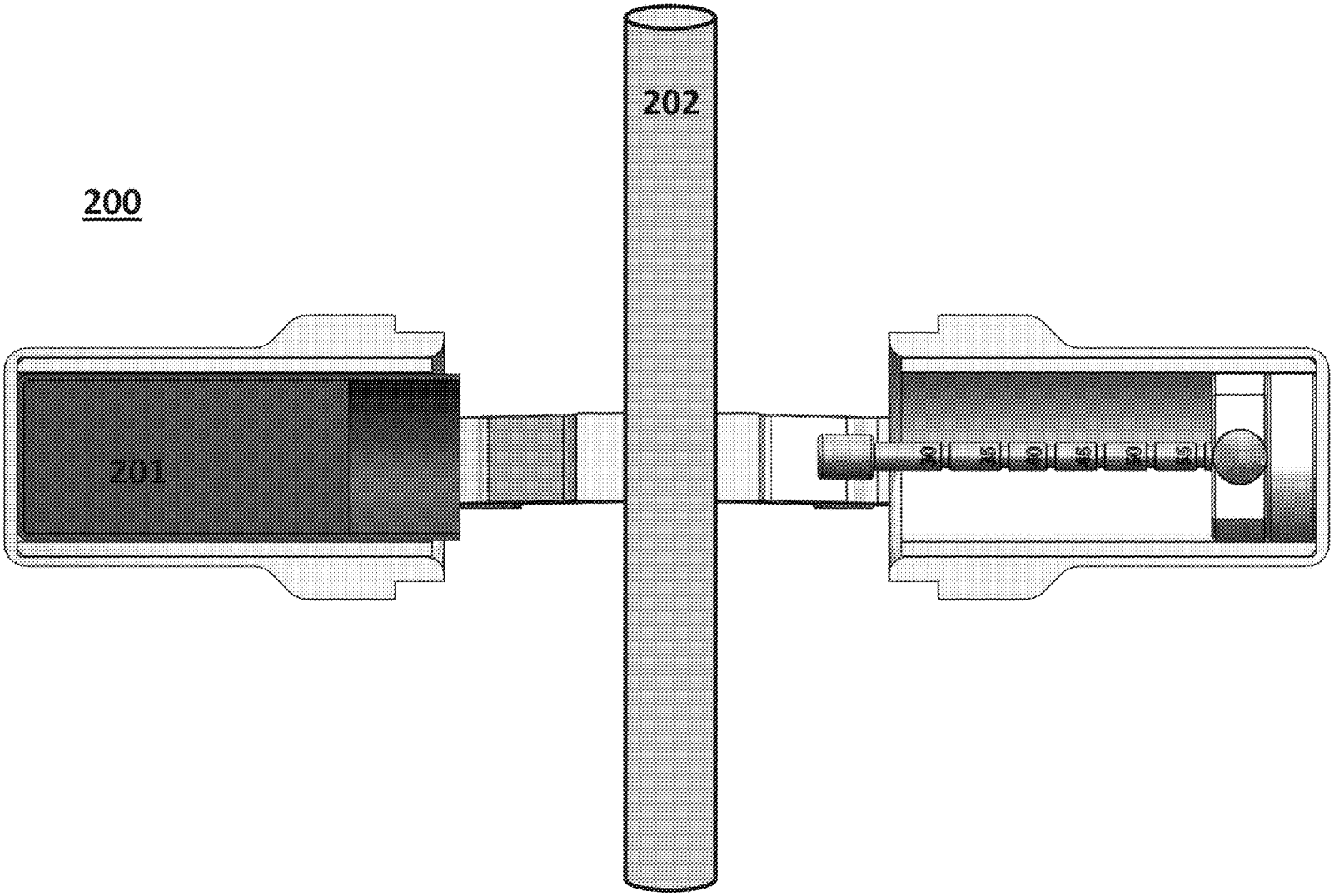
FIG. 2A-2B depict the centrifuge counterbalance positioned inside of a centrifuge rotor to balance a container having a liquid sample during centrifugation according to certain embodiments.
Figure 2B:
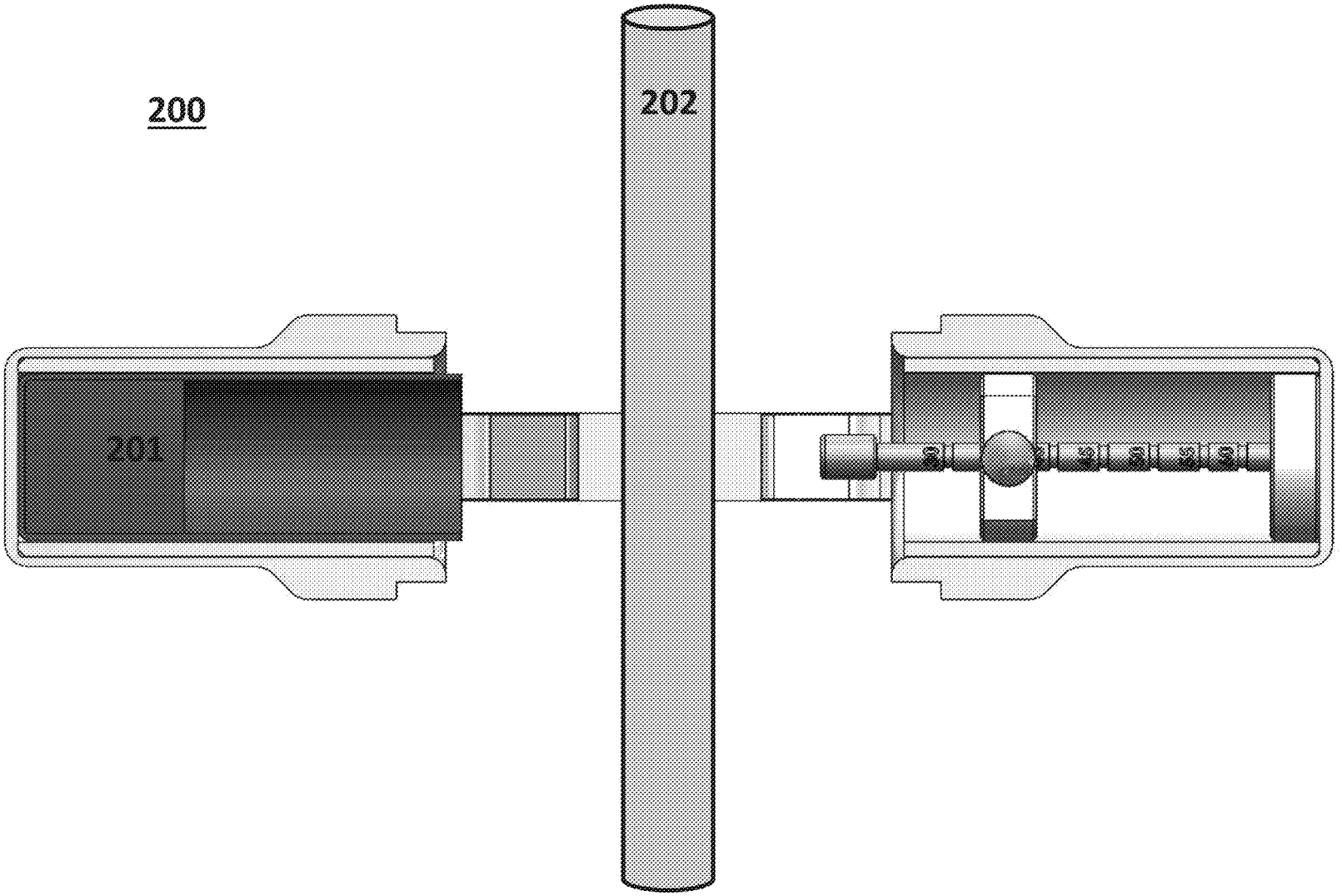

FIG. 2A-2B depict the centrifuge counterbalance positioned inside of a centrifuge rotor 200 to balance a liquid sample 201 during centrifugation according to certain embodiments. FIG. 2A depicts the weight of the centrifuge counterbalance at a first position where the weight is locked at the distal end of the shaft adjacent to the base. FIG. 2B depicts the weight of the centrifuge at a second position where the weight is locked to a position proximal to the first position on the shaft. During centrifugation, the centrifuge counterbalance is balanced with a container with liquid sample positioned in a diametrically opposed rotor compartment across axis 202.

Figures 3A, 3B:
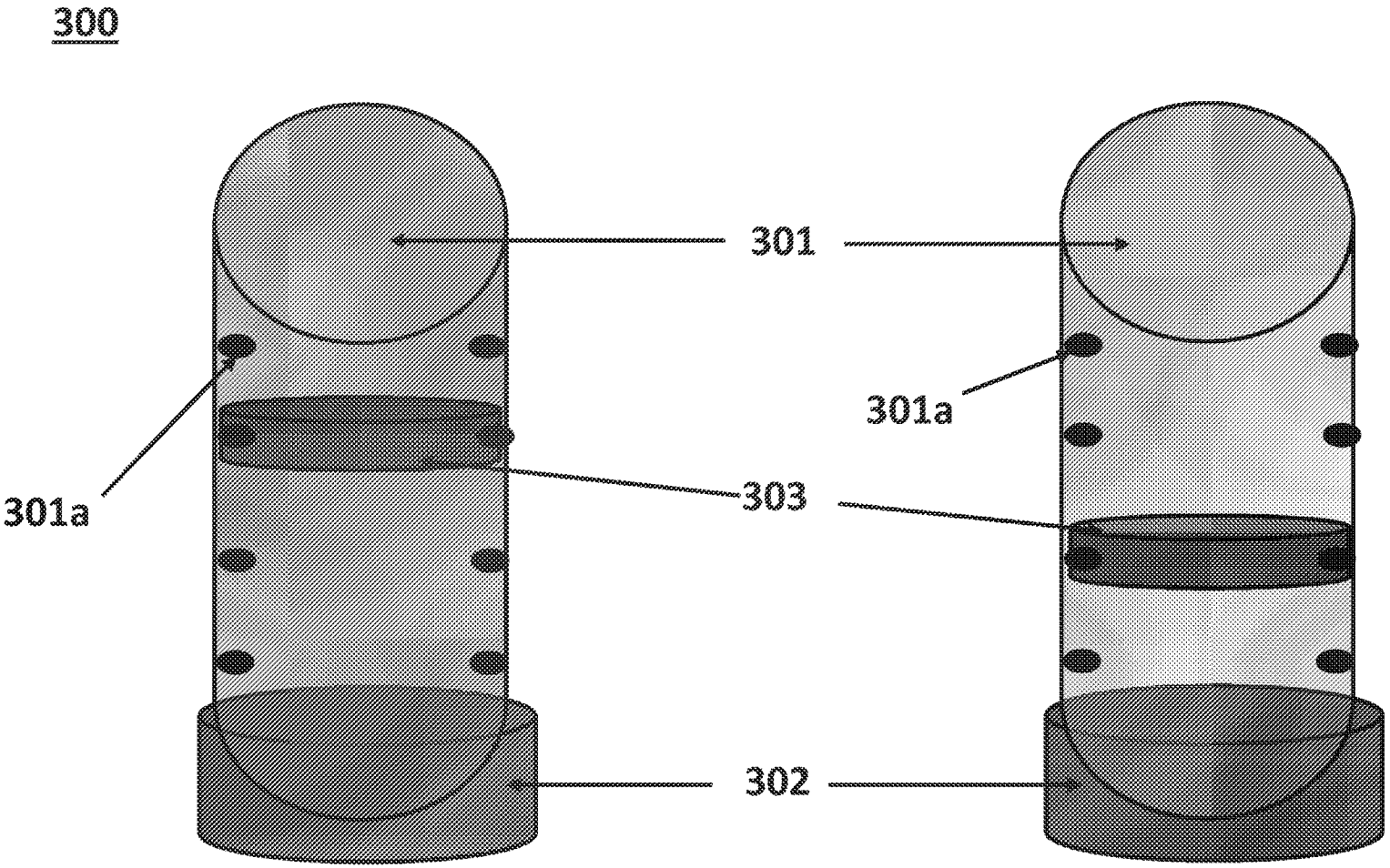
FIG. 3A-3B depicts an example of a centrifuge counterbalance having the weight at two different positions within an elongated housing according to certain embodiments. The centrifuge counterbalance includes a base, an elongated housing, and a moveable weight that is configured to be stably positioned at a specific location within the housing during centrifugation.

FIG. 3A-3B depicts an example of a centrifuge counterbalance according to certain embodiments having the weight at two different positions within an elongated housing. Device 300 includes an elongated housing (e.g., tube structure) 301, a base 302 fixed to the distal end of the elongated housing and a weight 303. In the first position, weight 303 is stably positioned spaced apart from base 302. The weight 303 is immobilized into position within housing 301 by fasteners 301*a*. In a second position, weight 303 is positioned closer to base 302 than in the first position and is immobilized within the housing 301 by fastener 301*a*.

Methods for Balancing a Centrifuge Rotor During Centrifugation

As summarized above, aspects of the disclosure also include methods for balancing a centrifuge rotor with the subject centrifuge counterbalances during centrifugation of a liquid sample. Methods according to certain embodiments include positioning a container having a liquid sample into a rotor compartment of a centrifuge, positioning a centrifuge counterbalance into the rotor compartment that is diametrically opposite the rotor compartment of the sample container and subjecting the container and centrifuge counterbalance to a force of centrifugation. As described above, to balance the centrifuge rotor, the weight is immobilized at a position along the longitudinal axis of the elongated body such that during centrifugation, the centrifuge counterbalance has a mass that is the same as the mass of the container with liquid sample. For example, during the subject methods, the weight is positioned along the longitudinal axis of the elongated body at a location such that during centrifugation the centrifuge counterbalance and the container differs in mass by 5% or less, such as 4% or less, such as 3% or less, such as 2% or less, such as 1% or less, such as 0.5% or less, such as 0.1% or less, such as 0.05% or less, such as 0.01% or less and including 0.001% or less.

In embodiments, the liquid sample may be a biological sample. Biological samples may include a whole organism, plant, fungi or a subset of animal tissues, cells or component parts which may in certain instances be found in blood, mucus, lymphatic fluid, synovial fluid, cerebrospinal fluid, saliva, bronchoalveolar lavage, amniotic fluid, amniotic cord blood, urine, vaginal fluid and semen. As such, a "biological sample" refers to both the native organism or a subset of its tissues as well as to a homogenate, lysate or extract prepared from the organism or a subset of its tissues, including but not limited to, for example, plasma, serum, spinal fluid, lymph fluid, sections of the skin, respiratory, gastrointestinal, cardiovascular, and genitourinary tracts, tears, saliva, milk, blood cells, tumors, organs. Biological samples may include any type of organismic material, including both healthy and diseased components (e.g., cancerous, malignant, necrotic, etc.). In certain embodiments, the biological sample is a liquid sample, such as whole blood or derivative thereof, bone marrow aspirate, stromal vascular fraction, plasma, tears, sweat, urine, semen, etc., where in some instances the sample is a blood sample, including whole blood, such as blood obtained from venipuncture or fingerstick (where the blood may or may not be combined with any reagents prior to assay, such as preservatives, anticoagulants, etc.). The term "blood sample" refers to whole blood or a subset of blood components, including but not limited to platelets, red blood cells, white cells and blood plasma. In some embodiments, the blood sample is obtained from an in vivo source and can include blood samples obtained from tissues (e.g., cell suspension from a tissue biopsy, cell suspension from a tissue sample, etc.) or directly from a subject. In some cases, blood samples derived from a subject are cultured, stored, or manipulated prior to evaluation.

In certain embodiments the source of the biological sample is a "mammal" or "mammalian", where these terms are used broadly to describe organisms which are within the class mammalia, including the orders carnivore (e.g., dogs and cats), rodentia (e.g., mice, guinea pigs, and rats), and primates (e.g., humans, chimpanzees, and monkeys). In some instances, the subjects are humans. The methods may be applied to samples obtained from human subjects of both genders and at any stage of development (i.e., neonates, infant, juvenile, adolescent, adult), where in certain embodiments the human subject is a juvenile, adolescent or adult. While the present disclosure may be applied to samples from a human subject, it is to be understood that the methods may also be carried-out on samples from other animal subjects (that is, in "non-human subjects") such as, but not limited to, birds, mice, rats, dogs, cats, livestock and horses.

In embodiments, the liquid sample may also be a biological sample (as described above) that includes one or more compounds, such as a preservative, antioxidant, stabilizer, surfactant, anticoagulant, chelating agent and the like. In certain instances, the multi-component liquid sample is whole blood or bone marrow aspirate that includes one or more anticoagulants. For example, the multi-component liquid sample may be whole blood or bone marrow aspirate that contains heparin or a calcium chelating agent (e.g., citrate or EDTA) The concentration of each compound in the biological sample may vary depending on the type and volume of biological sample and may be 0.001 mM or more, such as 0.005 mM or more, such as 0.01 mM or more, such as 0.05 mM or more, such as 0.1 mM or more, such as 0.5 mM or more, such as 1 mM or more, such as 5 mM or more, such as 10 mM or more, such as 100 mM or more, such as 500 mM or more, such as 1000 mM or more and including 5000 mM or more. For example, the concentration of the compounds in the biological sample may range from 0.001 mM to 5000 mM, such as from 0.01 mM to 1000 mM and including from 0.1 mM to 500 mM.

In practicing the subject methods according to certain embodiments, the appropriate position (i.e., to balance the centrifuge rotor) of the weight along the longitudinal axis of the elongated body (e.g., on the shaft) is determined using a reference identifier. In other embodiments, the appropriate position of the weight is determined by subjecting the sample container and centrifuge counterbalance to the force of centrifugation and readjusting the position of the weight until the centrifuge rotor exhibits little to no wobbling or vibration during centrifugation.

In the subject methods, the sample container and centrifuge counterbalance is subjected to a force of centrifugation one or more times. The term "force of centrifugation" is used herein in its conventional sense to refer to the force applied to the sample through revolving the device about an axis of rotation where the force on the components of the sample is in certain embodiments, given by the relative centrifugal force (RCF). In embodiments, any convenient centrifuge may be employed, such as for example a fixed-angle centrifuge, a swinging bucket centrifuge, ultracentrifuge, solid bowl centrifuges, conical centrifuges, among other types of centrifuges. The applied force of centrifugation (in relative centrifugal force, RCF) may vary depending on the sample type and size and may range from 1 g to 50,000 g, such as from 2 g to 45,000 g, such as from 3 g to 40,000 g, such as from 5 g to 35,000 g, such as from 10 g to 25,000 g, such as from 100 g to 20,000 g, such as from 500 g to 15,000 g and including from 1000 g to 10,000 g.

In embodiments, the sample is subjected to a force of centrifugation for a duration sufficient to separate components of different density into two or more fractions within the liquid sample. The duration the sample is subjected to the force of centrifugation may vary and may be 0.01 minutes or longer, such as for 0.05 minutes or longer, such as for 0.1 minutes or longer, such as for 0.5 minutes or longer, such as for 1 minute or longer, such as for 3 minutes or longer, such as for 5 minutes or longer, such as for 10 minutes or longer, such as for 15 minutes or longer, such as for 20 minutes or longer, such as for 30 minutes or longer, such as for 45 minutes or longer, such as for 60 minutes or longer and including for 90 minutes or longer.

Depending on the volume of sample and density dispersity of the sample components, the rotational speed of centrifugation may vary, such as from $1\times10^3$ revolutions per minute (rpm) to $1000\times10^3$ rpm, such as from $2\times10^3$ rpm to $900\times10^3$ rpm, such as from $3\times10^3$ rpm to $800\times10^3$ rpm, such as from $4\times10^3$ rpm to $700\times10^3$ rpm, such as from $5\times10^3$ rpm to $600\times10^3$ rpm, such as from $10\times10^3$ rpm to $500\times10^3$ rpm and including from $25\times10^3$ rpm to $100\times10^3$ rpm.

In certain embodiments, methods include subjecting the liquid sample to a force of centrifugation in two or more steps where the sample container and centrifuge counterbalance are subjected to a first force of centrifugation to separate the liquid sample into two or more fractions. In these embodiments, one or more of the fractions are removed and the sample container is repositioned into the rotor compartment. The weight of the centrifuge counterbalance, in these embodiments, is then adjusted to a second position along the longitudinal axis of the elongated body (e.g., on the shaft) to balance the centrifuge rotor. In some embodiments, depending on the number of components in the liquid sample of interest, more fractions from the liquid sample are removed after subsequent intervals of centrifugation (e.g., third, fourth, etc.) and the weight of the centrifuge counterbalance is adjusted to different (e.g., third, fourth, etc.) positions to balance the centrifuge rotor.

The speed of centrifugation during each step may be the same or different. In some embodiments, the speed of centrifugation is the same for every step. In other embodiments, the speed of centrifugation is different. The duration of centrifugation may also vary during each step where the duration of each step ranges from 0.1 minutes to 60 minutes, such as from 1 minute to 15 minutes.

When necessary, the position of the weight along the longitudinal axis of the elongated body may be changed at any time during the subject methods. For example, the position of the weight may be changed in response to vibration by the centrifuge rotor, in response to a change (increase or decrease) in rotation speed. In some embodiments, the position of the weight is changed two or more times during the subject methods, such as three or more times and including five or more times.

In certain embodiments, methods include monitoring the balance of the centrifuge rotor during centrifugation. Monitoring may include assessing (either by a human or with the assistance of a computer, if using a computer-automated process initially set up under human direction) the wobbling or vibration of the centrifuge rotor during centrifugation. For example, monitoring the balance of the centrifuge rotor may include visually identifying or manually feeling for vibration by the centrifuge rotor. Monitoring the balance of the centrifuge rotor may also include assessing the balance with computer-controlled sensors detecting the off-axis movement of the rotor during centrifugation or other convenient sensing protocols.

In some instances, monitoring includes collecting real-time data, such as employing a detector (e.g., with a video camera). In other instances, monitoring includes assessing the sample at regular intervals, such as every 0.01 minutes, every 0.05 minutes, every 0.1 minutes, every 0.5 minutes, every 1 minute, every 5 minutes, every 10 minutes, every 30 minutes, every 60 minutes or some other interval.

Methods of the present disclosure may also include a step of assessing the balance of the centrifuge rotor during centrifugation to identify any desired adjustments to the subject protocol. In other words, methods in these embodiments include providing feedback based on monitoring the centrifuge rotor, where adjustments to the protocol may vary in terms of goal, where in some instances the desired adjustment are adjustments that ultimately result in an improved balance of the centrifuge rotor, reduced vibration and wobbling of the centrifuge rotor, reduced noise by the centrifuge rotor during centrifugation or some combination thereof.

Where feedback provided indicates that a particular protocol is less than optimal, such as where the centrifuge rotor vibrates or wobbles too violently during centrifugation, methods may include repositioning the weight at a different position along the longitudinal axis of the elongated body (e.g., on the shaft), repositioning the base at a different position, locking the weight in position, fixing the base to the distal end of the elongated body or some combination thereof.

Systems for Centrifugation

Aspects of the present disclosure also include systems for practicing the subject methods. As discussed above, methods for balancing a centrifuge rotor include positioning a container having a liquid sample into a rotor compartment of a centrifuge, positioning the centrifuge counterbalance in a rotor compartment that is diametrically opposite the rotor compartment of the sample container and subjecting the container and centrifuge counterbalance to a force of centrifugation sufficient to produce two or more fractions in the liquid sample.

In some embodiments, systems include one or more of the centrifuge counterbalances described above and a centrifuge rotor for positioning the centrifuge counterbalance and a container with a liquid sample in a centrifuge. In one example, the centrifuge rotor is a fixed angle rotor. In another example, the centrifuge rotor is a swinging bucket rotor.

In addition, systems of interest may also include a centrifuge for applying a force of centrifugation to the liquid sample. The term "centrifuge" is used herein in its conventional sense to refer to an apparatus for rotating one or more of the subject separation devices about a rotation axis to apply a centrifugal force to the components of the sample in the device container. Any convenient centrifuge protocol may be employed, including but not limited to fixed-angle centrifuges, swinging bucket centrifuges, ultracentrifuges, solid bowl centrifuges, conical centrifuges, among other types of centrifuges. In certain embodiments, the centrifuge is a centrifuge with a horizontal rotor. In other embodiments, the centrifuge is a centrifuge with a fixed angle rotor. For example, the centrifuge may be a Horizon Model 755VES centrifuge (Drucker Co., Port Matilda Pa.) having a horizontal rotor or fixed angle rotor and brushless DC motor.

As described above, the subject centrifuges may be configured to apply a force of centrifugation which varies, depending on the type of sample, size of separation device and desired separation of sample components. In embodiments, centrifuges of interest may apply a force of centrifugation which ranges (in relative centrifugal force, RCF) from 1 g to 50,000 g, such as from 2 g to 45,000 g, such as from 3 g to 40,000 g, such as from 5 g to 35,000 g, such as from 10 g to 25,000 g, such as from 100 g to 20,000 g, such as from 500 g to 15,000 g and including from 1000 g to 10,000 g. Accordingly, centrifuges of interest may be configured to operate a rotation speeds which vary widely, such as from $1\times10^3$ revolutions per minute (rpm) to $1000\times10^3$ rpm, such as from $2\times10^3$ rpm to $900\times10^3$ rpm, such as from $3\times10^3$ rpm to $800\times10^3$ rpm, such as from $4\times10^3$ rpm to $700\times10^3$ rpm, such as from $5\times10^3$ rpm to $600\times10^3$ rpm, such as from $10\times10^3$ rpm to $500\times10^3$ rpm and including from $25\times10^3$ rpm to $100\times10^3$ rpm.

The centrifuge may also be a temperature controlled centrifuge, where the temperature of the sample in the subject devices may be maintained or changed (e.g., increased or decreased) as desired. For example, the centrifuge may be configured to maintain the temperature of the sample in the subject devices from −80° C. to 100° C., such as from −75° C. to 75° C., such as from −50° C. to 50° C., such as from −25° C. to 25° C., such as from −10° C. to 10° C., and including from 0° C. to 25° C.

Centrifuges of interest may also be configured with monitoring protocols for assessing balance of the centrifuge rotor during centrifugation. For example, the centrifuge may include a viewing window to visualize the centrifuge rotor or may include one or more sensors, such as a balance sensor, off-axis motion sensor or vibration sensor, or some other sensing protocol.

Kits

Aspects of the invention further include kits, where kits include one or more of the subject centrifuge counterbalances as described herein. In some instances, the kits can include one or more additional components (e.g., buffers, water, solvent etc.). In some instances, the kits may further include a sample collection device, e.g., blood collection device such as an evacuated blood collection tube, needle, syringe, pipette, tourniquet, etc. as desired. Kits may also include decoders for reference identifiers on the shaft.

The various assay components of the kits may be present in separate containers, or some or all of them may be pre-combined. For example, in some instances, one or more components of the kit, e.g., the elongated body (e.g., shaft, housing), weight and base are present in a sealed pouch, e.g., a sterile foil pouch or envelope.

In addition to the above components, the subject kits may further include (in certain embodiments) instructions for assembling the subject kit components as well as for practicing the methods for balancing a centrifuge rotor as described herein. These instructions may be present in the subject kits in a variety of forms, one or more of which may be present in the kit. One form in which these instructions may be present is as printed information on a suitable medium or substrate, e.g., a piece or pieces of paper on which the information is printed, in the packaging of the kit, in a package insert, and the like. Yet another form of these instructions is a computer readable medium, e.g., diskette, compact disk (CD), portable flash drive, and the like, on which the information has been recorded. Yet another form of these instructions that may be present is a website address which may be used via the internet to access the information at a removed site.

Utility

The subject devices, methods and systems find use in a variety of applications where centrifugation is employed to separate components of a liquid sample and precise balance is needed during centrifugation. The subject devices also find use in centrifuges that are highly sensitive to vibrations or centrifuges which can be damaged by wobbling rotors by even slight imbalance. Embodiments of the present disclosure also find use in purifying components of a biological sample, such as whole blood and bone marrow aspirate where it is desirable to obtain isolated components of blood (e.g., white blood cells, stem cells, red blood cells, platelets, plasma, etc.) In some embodiments, the present disclosure finds use in preparing blood products having therapeutic applications, such as platelet rich plasma. Embodiments also find use in the preparation of samples from multi-component liquid where only certain components are desired, such as for laboratory assays, diagnostic tests or for other research applications.

The subject centrifuge counterbalances provide a simpler, faster, less expensive means of counter balancing centrifuges. It further minimizes the skill and training of the person operating the centrifuge and reduces the likelihood of an adverse experience due to centrifuge imbalance occurring during research.

EXAMPLES

Experiments were performed demonstrating that excellent counter balance functionality was achieved between a centrifuge tube filled with blood and a mechanical counter balance shown depicted in FIG. 1A-1C. During centrifugation, the counterbalances sufficiently maintained balance of the centrifuge, the centrifuge exhibiting little to no wobbling or violent vibration. This result was surprising given the gross difference in mass, shape and size of the two objects being centrifuged in opposite buckets.

Although the foregoing invention has been described in some detail by way of illustration and example for purposes of clarity of understanding, it is readily apparent to those of ordinary skill in the art in light of the teachings of this disclosure that certain changes and modifications may be made thereto without departing from the spirit or scope of the appended claims.

Accordingly, the preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims.

What is claimed is:

1. A centrifuge counterbalance having an adjustable center of gravity and configured for use with a centrifuge rotor comprising a first rotor compartment diametrically opposed from a second rotor compartment, each rotor compartment having inner walls, wherein the inner walls of the first rotor compartment are of equal size and shape to the inner walls of the second rotor compartment, and wherein the centrifuge counterbalance comprises: an elongated body comprising a distal end and a proximal end; a base configured to be reversibly immobilized into a position on the elongated body and configured to be displaced along a longitudinal axis of the elongated body, wherein the base is configured to operably couple the centrifuge counterbalance to the first centrifuge rotor compartment, and wherein the cross-section of the base is configured to be complementary to the inner walls of the first and the second centrifuge rotor compartments; and a weight coupled to the elongated body, wherein the weight is configured to be displaced along the longitudinal axis of the elongated body, and wherein the weight is configured to be reversibly immobilized at a position on the longitudinal axis of the elongated body; wherein the center of gravity of the centrifuge counterbalance is adjusted by immobilizing the weight at different positions along the longitudinal axis of the elongated body.

2. The centrifuge counterbalance according to claim 1, wherein the elongated body is a shaft wherein the weight is configured to be displaced along a longitudinal axis on the shaft.

3. The centrifuge counterbalance according to claim 2, wherein the weight comprises a hole extending through the weight.

4. The centrifuge counterbalance according to claim 3, wherein the shaft extends through the hole.

5. The centrifuge counterbalance according to claim 2, wherein the shaft comprises a fastener.

6. The centrifuge counterbalance according to claim 5, wherein the fastener comprises grooves along the longitudinal axis of the shaft.

7. The centrifuge counterbalance according to claim 2, wherein the weight comprises a lock to fix the weight at a position along the longitudinal axis of the shaft.

8. The centrifuge counterbalance according to claim 7, wherein the lock comprises a locking latch, a locking pin or a locking screw.

9. The centrifuge counterbalance according to claim 2, wherein the base is fixed to the distal end of the shaft.

10. The centrifuge counterbalance according to claim 1, wherein the base comprises a hole that extends through the base.

11. The centrifuge counterbalance according to claim 1, wherein the shaft extends through the hole.

12. The centrifuge counterbalance according to claim 1, wherein the elongated body is a housing, wherein the weight is configured to be displaced along a longitudinal axis within the housing.

13. A system comprising:

a centrifuge; and a centrifuge counterbalance of claim 1.

14. The centrifuge counterbalance according to claim 1, wherein the base is shaped for positioning in a cylindrical rotor compartment.

15. A method for balancing a centrifuge rotor comprising a first rotor compartment diametrically opposed from a second rotor compartment, each rotor compartment having inner walls, wherein the inner walls of the first rotor compartment are of equal size and shape to the inner walls of the second rotor compartment, and wherein the first rotor compartment comprises a sample container, the method comprising: a. providing or having provided a centrifuge counterbalance having an adjustable center of gravity, wherein the centrifuge counterbalance comprises: i. an elongated body comprising a distal end and a proximal end; ii. a base configured to be reversibly immobilized into a position on the elongated body and configured to be displaced along a longitudinal axis of the elongated body, wherein the base is configured to operably couple the centrifuge counterbalance to the first centrifuge rotor compartment, and wherein the cross-section of the base is configured to be complementary to the inner walls of the first and the second centrifuge rotor compartments; and iii. a weight coupled to the elongated body, wherein the weight is configured to be displaced along the longitudinal axis of the elongated body, and wherein the weight is configured to be reversibly immobilized at a position on the longitudinal axis of the elongated body; b. adjusting the center of gravity of the centrifuge counterbalance to balance the sample container during centrifugation by immobilizing the weight of the centrifuge counterbalance at a position along the longitudinal axis of the elongated body; c. positioning the centrifuge counterbalance of step (b) into the second rotor compartment of the centrifuge rotor; and d. subjecting the container comprising the liquid sample and the centrifuge counterbalance to a force of centrifugation sufficient to produce two or more fractions in the sample.

* * * * *